United States Patent [19]

Ducati

[11] 4,420,380

[45] Dec. 13, 1983

[54] METHOD FOR EXTRACTING HEAVY METALS FROM SULPHURATED MINERAL CONCENTRATES

[75] Inventor: Umberto Ducati, Milan, Italy

[73] Assignee: Gianfranco Rambaldini, Concesio, Italy

[21] Appl. No.: 242,091

[22] Filed: Mar. 9, 1981

[51] Int. Cl.[3] ..... C25C 3/00; C25C 3/34

[52] U.S. Cl. ..... 204/66; 204/61 R

[58] Field of Search ..... 204/66

[56] References Cited

U.S. PATENT DOCUMENTS

| | | | |
|---|---|---|---|
| 510,276 | 12/1893 | Lyte | 204/66 |
| 1,299,947 | 4/1919 | Ingeberg | 204/66 |
| 1,748,748 | 2/1930 | Ashcroft | 204/66 |
| 4,011,146 | 3/1977 | Coltrinari et al. | 204/66 |

FOREIGN PATENT DOCUMENTS

| | | | |
|---|---|---|---|
| 19441 | of 1905 | Austria | 204/66 |
| 10829 | of 1897 | United Kingdom | 204/66 |
| 14278 | of 1899 | United Kingdom | 204/66 |

*Primary Examiner*—Howard S. Wiliams

*Attorney, Agent, or Firm*—Guido Modiano; Albert Josif

[57] ABSTRACT

An electrolytic method is described for extracting heavy metals, in particular lead, from sulphide concentrates, wherein the concentrates are dissolved in molten chlorides and chlorinated. Then the chlorides of the metals to be extracted are subjected to electrolysis in molten salts, and the vapor phase sulphur separated by the chlorination step is then recovered as elemental sulphur.

9 Claims, 1 Drawing Figure

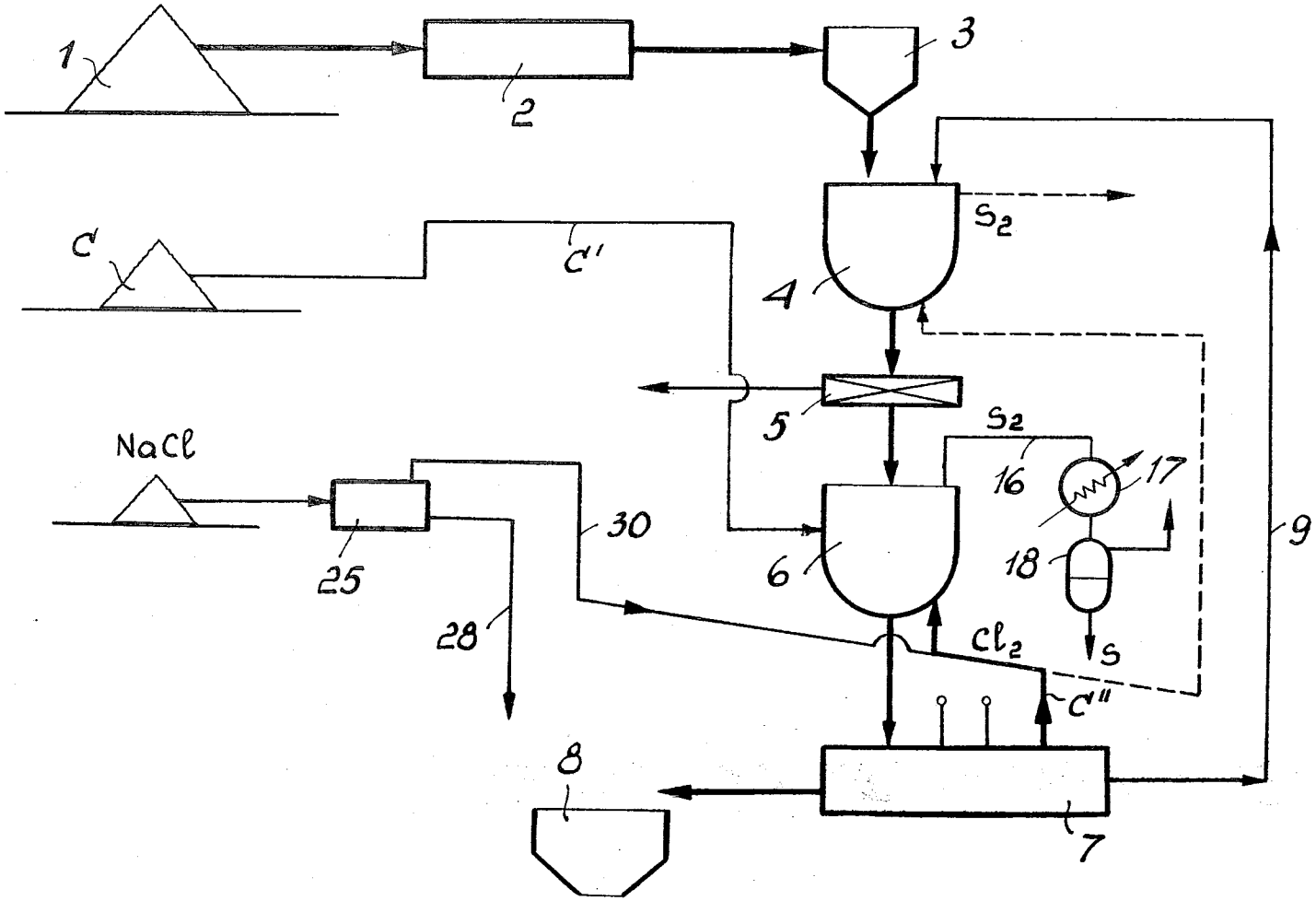
1
2
3
4
5
6
7
8
9
16
17
18
25
28
30
C
C'
C''
S2
S2
Cl2
S
NaCl

METHOD FOR EXTRACTING HEAVY METALS FROM SULPHURATED MINERAL CONCENTRATES

BACKGROUND OF THE INVENTION

This invention relates to a method for extracting heavy metals from sulphurated, or partly sulphurated, mineral concentrates containing them. More specifically, the invention concerns a method for extracting low-melting heavy metals from the respective sulphurated concentrates, and it will be understood that, even if specific reference is made hereinafter to the extraction of lead, the inventive method is equally suitable for the production of other low-melting heavy metals from respective, at least in part sulphurated, mineral concentrates, e.g. for the production of zinc.

Thus, with illustrative reference to lead, it is known that the production of primary lead is currently accomplished mainly through pyrometallurgic processes which, in accordance with traditional dual-stage techniques, involve first the oxidation and sintering of the concentrates, followed by their reduction with coal in a wind furnace, and according to more recent single-stage processes, involve direct smelting of the concentrates with oxygen, yielding impure lead (lead bullion) and sulphur dioxide.

The aforementioned pyrometallurgical methods have certain recognized drawbacks, among which, in the instance of the cited traditional processes, high material and energy consumption, and serious environment pollution problems, this latter disadvantage affecting also the more recently developed processes cited above. In fact, not completely solved in the direct smelting processes is the problem of dust and fume generation (the potential harmfulness whereof is well known, especially in the event of escape and leakage), as due also to the fact that the operating temperatures equal or exceed those of the traditional two-stage methods of reducing lead.

As an alternative to the pyrometallurgical methods, lead extraction methods by electrolysis in molten salts have also been proposed. In such electrolytical processes, the raw material used is galena (PbS) dissolved in a bath of molten chlorides. However, the electrolytic process for the production of lead from concentrates has proved to have some drawbacks both as carried out originally and as improved thereafter. First of all, a low process efficiency, as due to the sulphur released at the anode tending to dissolve in the electrolyte melt to form polysulphides. Moreover, the gangue present in the concentrates accumulates in the electrolyte bath, to create unacceptable slurries.

SUMMARY OF THE INVENTION

A primary object of this invention is to provide an electrochemical method for extracting lead from sulphurated, or partly sulphurated, concentrates containing it, which method can be implemented with a high power efficiency and is itself highly efficient.

A further object of the invention is to provide a method as above, which involves no special and costly arrangements, can be implemented starting with low cost readily available raw materials and through commonly available equipment, thereby it is economically advantageous.

Another object of the invention is to provide a method for molten salt lead electrowinning which lends itself also to the treatment of lean minerals as well as minerals with a high content of oxidized components without involving any large increase in the production cost.

A not unimportant object of this invention is to provide a method as outlined above, which affords the possibility of obtaining non-polluting by-products which are also valuable from an economical standpoint.

These and other objects, such as will be apparent hereinafter, are achieved by a method for extracting heavy metals from at least partly sulphurated mineral concentrates containing them, characterized in that it comprises the steps of dissolving said concentrates in a bath of molten chlorides, chlorinating the sulphides by injecting chlorine gas into the bath, and subjecting then the bath to electrolysis to separate said heavy metals on the cathode and chlorine on the anode.

BRIEF DESCRIPTION OF THE DRAWING

Further features and advantages of the method according to the invention will be apparent from the following illustrative and not limitative description thereof, with reference to the accompanying drawing, the one figure whereof shows a process diagram of one embodiment of the method.

DESCRIPTION OF THE PREFERRED EMBODIMENTS

With particular reference to the application of this method to the production of lead, the concentrated lead mineral or galena (PbS) is dissolved in a bath of molten chloride, with which it forms a homogeneous solution. Preferably, as the solution bath, a mixture of alkaline chloride is used, in particular KCl and NaCl, in the 25–75:75–25 ratios, preferably with the addition of lead chloride, typically in a ratio of KCl to NaCl to $PbCl_2$ equal to 45:45:10. Lead sulphide forms with that bath a homogeneous solution above 500° C., the melting point being liable to be lowered by increasing the content of $PbCl_2$ of the bath. A chlorination of the sulphides is then carried out by dry chlorine bubbling within the molten salt bath. Since the lead sulphide decomposition voltage is 0.466 Volts at 550° C., whilst at that same temperature the lead chloride standard decomposition voltage is b 1.24 Volts, the sulphide displacement reaction by chlorine $$PbS + Cl_2 = PbCl_2 + \tfrac{1}{2}S_2 \ (T = 550°\ C.)$$

has a driving voltage in excess of 0.7 Volts available, which, on account of the very low overvoltages normally occurring in the molten salts, is high enough to ensure that the displacement process can occur at an acceptable rate.

In order to reduce the nucleation work of the sulphur gas bubbles, and to improve the mixing of gaseous chlorine, it may be expedient to carry out this process in the presence of carbon, which also facilitates the electron exchanges between the $S^{2-}$ions in solution and gaseous $Cl_2$. The process is conducted at a temperature in excess of 450° C., that is above the boiling point (444.6° C.) of sulphur, and is in all cases feasible within a range of temperatures from 450° C. to 850° C. In such conditions, sulphur, as displaced by chlorine, is converted into gaseous sulphur, which is then recovered as elemental sulphur with conventional methods, e.g. condensed within a condenser and then cast or scrubbed in an ejector-cyclone system and recovered in powder form.

Thereafter, the liquid phase containing chlorides of the metals to be recovered, in particular lead, is passed to an electrolysis section where lead can be recovered by application of suitable voltages (1.3–1.5 Volts) as is current practice for electrolytically reducing lead from molten salts with graphite anodes and liquid metal cathodes. If desired, it will be readily possible, by operating with suitable voltage levels for different cells, to produce alloys rich in the metals which accompany the lead sulphide in the concentrate, such as silver, bismuth, and zinc.

Thus, with the method according to the invention, it is lead chloride rather than sulphide which undergoes electrolysis, thereby the problems posed by the formation of polysulphides and consequent drop of the current efficiency, as affecting conventional methods, are obviated.

The chlorine released at the anodes of the electrolytic cells during the electrolysis step is cycled back to the chlorination step where it represents a major portion of the chlorine in the process. Any small losses of chlorine can be made good with the addition of suitable small amounts of integrating chlorine (topping up), e.g. as suitably prepared by electrolysis in a soda chlorine plant, this also serving to start the system.

The process according to the invention is illustrated diagrammatically in the accompanying drawing. The concentrated mineral 1, as previously dried at 2, is loaded by means of a loading hopper 3 into one or more digesters 4 for dissolving it in the molten salt bath at a higher temperature than 450° C. Then the liquid bath, after flowing through a filter 5 for the removal of the gangue, is loaded into one or more chlorinators 6 which are fed with chlorine gas until the sulphides are fully chlorinated.

To the chlorinator(s) 6, carbon C may also be supplied through the carbon supply duct C′, and said carbon C, as explained hereinabove, facilitates the further chlorination of the sulphides.

From the chlorinators 6, as hereinabove stated, the sulphide ions, as displaced by chlorine, convert into sulphur vapours which are recovered through the duct 16 and then either condensed within a condenser 17 and cast from 18 or brought down in an ejector-cyclone system (not shown) and recovered in powder form. The chloride enrichened molten bath is next passed to electrolytic cells 7 where the metal separated at the cathode is discharged in the form of liquid metal 8, whereas the chlorine separated at the anode is cycled back to the chlorinator(s) 6 through the chlorine recycling duct C″. The spent molten bath from the electrolysis step, which contains the alkaline chlorides with solvent functions, is cycled back through the returning duct 9 to the digester(s) 4 for dissolving more charges of sulphide concentrates.

For completeness it should be noted that chlorine can be produced according to any suitable method, for example, as it is shown in the Figure, starting from NaCl to be processed in a chlorine soda producing unit 25, wherefrom soda and chlorine are removed through the duct 28 and 30 respectively.

The method according to this invention also lends itself for the treatment of partly oxidized minerals, for which the presence of carbon in the chlorination step is indispensable both for chlorinating and to avoid the formation of $SO_2$ in favor of the formation of $CO_2$ and CO, since the respective free energies are, at 600° C., $\Delta G_f^{o},_{SO_2} = -75$ KCal/$O_2$ mole and $\Delta G_f^{o},_{CO_2} = -95$ KCal/$O_2$ mole approximately.

Therefore, the process adapts even significant percentages of oxidized mineral, in which case the process would contemplate a certain increase in the carbon consumption.

It will be appreciated from the foregoing that the method according to this invention does achieve its objects. In fact, it can be carried out at comparatively low temperatures (450°–650° C.), which prevents the volatilization of metal compounds and the formation of dust. The electrolysis of lead chloride avoids the problems connected with the electrolytic treatment of lead sulphide, and especially with the low current efficiency exhibited by conventional methods owing to the formation of polysulphide by-products. The process yields pure sulphur instead of sulphur oxides, thus making it unnecessary to produce sulphuric acid in order to bring down the sulphur dioxide, which operation would be uneconomical for limited outputs below $10^5$ to $10^6$ tons/year of acid. The pure sulphur yielded by the process is, moreover, a quality product which is highly demanded.

Furthermore, with suitable modifications in the bath composition, such as are well within the capabilities of those skilled in the art, it becomes possible to either favor or inhibit the dissolving in the molten chlorides of other metals present therein, such as sulphides in the concentrated mineral, thereby lean minerals or minerals containing undesired impurities may also be treated with the same process. Also, and as already outlined, minerals may be treated which contain significant amounts of oxidized components. In addition, the electrochemical nature of the process makes it relatively little output sensitive, and makes its application feasible in an economically advantageous manner even for small outputs (even of a few thousands of tons/year).

Those skilled in the art will readily recognize that the method of this invention, as described hereinabove, should not be restrictive to the embodiment illustrated, and may be variously modified without departing from the scope of the invention as described hereinabove and claimed in the appended claims.

I claim:

1. A method for extracting heavy metals from mineral concentrates containing said heavy metals at least partly in sulphurated and at least partly in oxidized form, characterized in that it comprises the steps of dissolving said concentrates in a bath of molten alkali metal chlorides, or of a mixture of prevailing amount of said alkali metal chlorides with a lower amount of chlorides of said heavy metals, chlorinating the concentrates by injecting chlorine gas into the bath to which carbon has been added in an amount sufficient to prevent formation of sulphur dioxide, whereby vapors of pure sulphur are evolved as by-product, said chlorination being carried out at a temperature in the range of from 450° to 650° C, and subjecting then the bath to electrolysis to separate said heavy metals to the cathode and chlorie to the anode.

2. A method according to claim 1, wherein the chlorine separated by electrolysis is cycled back to said chlorinating step.

3. A method according to claim 1, further comprising an additional step of recovering said sulphur released in vapor form during said chlorinating step, either by condensation and casting or by bringing the sulphur down from the vapor phase.

4. A method according to claim 1, wherein said molten alkali metal chloride bath includes mixtures of KCL and NaCl in a ratio of from 25–75 to 75–25, or said mixtures with up to 40% of the mixture of chlorides of said heavy metals to be extracted.

5. A method according to claim 1, of producing lead from mineral concentrates containing it at least in parts as sulphides and at least in part as oxides, characterized in that it comprises the steps of dissolving said concentrates in a bath of molten alkali metal chlorides, or of a mixture of a prevailing amount of said alkali metal chlorides with a lower amount of lead chloride effecting a chlorination of the concentrates by injecting chlorine gas into the bath in the presence of carbon added in an amount sufficient to prevent formation of sulphur dioxide, whereby vapors of pure sulphure are evolved as by-product said chlorination, being carried out, at a temperature in the range of from 450° to 650° C. and subjecting said bath to electrolysis for separating lead to the cathode and chlorine to the anode.

6. A method according to claim 5, wherein the chlorine separated to the anode is cycled back to said chlorination step.

7. A method according to claim 5, comprising an additional step of recovery of the sulphur released in vapor form during said chlorination step either by condensation and casting or by bringing said sulphur down from the vapor phase.

8. A method according to claim 5, wherein said molten alkali metal chloride bath includes mixtures of KCL and NaCl in a ratio of from 25–75 to 75–25 or said mixtures with up to 40% of the mixture of lead chlorides.

9. A method according to claim 8, wherein said molten chloride bath includes a mixture of sodium chloride, potassium chloride, and lead chloride in a ratio of 45:45:10.

* * * * *